US008310160B1

(12) United States Patent
Xiong et al.

(10) Patent No.: US 8,310,160 B1
(45) Date of Patent: Nov. 13, 2012

(54) ANTI-ARCING CIRCUIT FOR CURRENT-FED PARALLEL RESONANT INVERTER

(75) Inventors: Wei Xiong, Madison, AL (US); Christopher Radzinski, Huntsville, AL (US); Travis Berry, Madison, AL (US); Donald Folker, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 571 days.

(21) Appl. No.: 12/555,524

(22) Filed: Sep. 8, 2009

Related U.S. Application Data

(60) Provisional application No. 61/160,895, filed on Mar. 17, 2009.

(51) Int. Cl.

| | |
|---|---|
| ***H05B 37/00*** | (2006.01) |
| ***H05B 37/02*** | (2006.01) |
| ***H05B 41/00*** | (2006.01) |
| ***H05B 41/36*** | (2006.01) |
| ***G05F 1/00*** | (2006.01) |

(52) U.S. Cl. ..... 315/120; 315/209 R; 315/291

(58) Field of Classification Search ..... 315/120, 315/121, 209 R, 312, 307, 224, 291, 274, 315/246, 247

See application file for complete search history.

(56) References Cited

U.S. PATENT DOCUMENTS

| | | | | |
|---|---|---|---|---|
| 6,809,483 | B2 * | 10/2004 | Alexandrov | 315/224 |
| 7,042,161 | B1 * | 5/2006 | Konopka | 315/119 |
| 7,091,676 | B2 * | 8/2006 | Rodriguez et al. | 315/307 |
| 7,288,901 | B1 * | 10/2007 | Yu et al. | 315/291 |
| 7,312,588 | B1 | 12/2007 | Yu et al. | |
| 7,327,101 | B1 | 2/2008 | Chen et al. | |
| 7,405,522 | B2 * | 7/2008 | Stack | 315/127 |
| 7,450,522 | B2 * | 11/2008 | Feder et al. | 370/252 |
| 7,468,586 | B2 * | 12/2008 | Yu et al. | 315/307 |
| 7,598,677 | B2 * | 10/2009 | Stack | 315/127 |
| 7,768,755 | B1 * | 8/2010 | Xiong et al. | 361/91.1 |
| 8,004,217 | B2 * | 8/2011 | Mortimer et al. | 315/360 |
| 2007/0029943 | A1 * | 2/2007 | Erhardt et al. | 315/209 R |

* cited by examiner

*Primary Examiner* — Shawki S Ismail
*Assistant Examiner* — Dylan White
(74) *Attorney, Agent, or Firm* — Waddey & Patterson, P.C.; Mark J. Patterson

(57) ABSTRACT

An arc protection circuit is provided for a current-fed, parallel-resonant inverter ballast, the circuit having a lamp signal sensing circuit coupled across one or more lamps and designed to detect a signal through the lamps, a shutdown circuit coupled to the sensing circuit and operable to disable the ballast in response to a disturbance such as an arc in the detected signal, at least a portion of the shutdown circuit defining a first time delay from detection of the disturbance in the signal during which the ballast operates normally, and after which the ballast may be disabled in response to the disturbance; and an automatic restart circuit coupled to the shutdown circuit and operable to enable restarting of the ballast, at least a portion of the restart circuit defining a second time delay during which the ballast remains disabled, after which the ballast may be restarted.

8 Claims, 4 Drawing Sheets

ANTI-ARCING CIRCUIT FOR CURRENT-FED PARALLEL RESONANT INVERTER

CROSS-REFERENCES TO RELATED APPLICATIONS

This application claims benefit of the following patent application(s) which is/are hereby incorporated by reference: U.S. Provisional Patent Application No. 61/160,895 filed Mar. 17, 2009.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to circuitry for instant-start gas-discharge lamp ballasts. More particularly, the present invention relates to circuitry designed to overcome arcing problems associated with current-fed, parallel-resonant inverter topologies used in electronic ballasts.

The instant-start type of fluorescent lamp ballast has the advantage of fast starting. It is very cost-effective and is particularly appropriate for long, continuous operation. A current-fed parallel-resonant inverter topology is known in the art as a particularly good solution for this kind of instant start application.

Referring to FIG. 1, an example of a typical topology for traditional dual lamp current-fed parallel-resonant circuits is shown. In this example, it may be understood by one of skill in the art that V_bus is typically provided from a power factor control (PFC) circuit output. Capacitors C1 and C2 may be large electrolytic components with C1 equal to C2. Q1 and Q2 are bipolar junction transistors (BJTs) that are used as switching components. D1 and D2 are free-wheeling diodes associated with transistors Q1 and Q2. Resonant capacitor C_Res and the primary winding of the main transformer T_Res_P form the main resonant tank.

In the load circuit 2 shown, two lamps Lamp_1 and Lamp_2 are connected with the secondary winding of the main transformer T_Res_S through ballast capacitors C5 and C6.

Prior to starting, V_Bus charges capacitor C4 through resistive network R3 and R4. When the voltage across C4 reaches the breakdown voltage of the diac 3, diac 3 breaks down and looks like a short circuit so that the voltage on capacitor C4 turns on the switching component Q2. After Q2 is turned on, the circuit begins to resonate and the secondary winding of the main transformer T_Res_S, T_Res_base_1, and T_Res_base_2 continue driving Q1 and Q2 such that the inverter reaches a steady state.

However, potential arcing within lamp-holders of instant-start type ballasts is a phenomenon that has been recognized as an undesirable effect to be mitigated. Such ballasts may have ignition voltages double or more that of a preheat type of ballast, and are therefore more conducive generally to potentially damaging arcing. Arcing may occur during re-lamping conditions where a gas discharge lamp is installed or replaced during live application of AC power. This form of arcing is relatively instantaneous and potentially undesirable. However, arc detection should generally be suppressed during certain conditions such as normal startup or inverter ignition given the varying needs of gas discharge lamps. On the other hand, sustained arcing that occurs because of improper connections may be far more damaging and must be quickly and efficiently addressed.

It is therefore desirable that an arc protection circuit be designed for use with a fluorescent lamp using an instant-start type ballast.

It is further desirable that the circuit provide inverter shutdown capability for current-fed parallel-resonant inverter topologies with a predetermined time delay to prevent false or otherwise undesirable shutdowns.

It is further desirable that the circuit provide auto-restart capability for current-fed parallel-resonant inverter topologies with a predetermined time delay after disabling of the inverter.

BRIEF SUMMARY OF THE INVENTION

The present invention is a protection circuit for use with electronic ballasts using current-fed, parallel resonant inverters to drive one or more gas discharge lamps. More particularly, the present invention is a circuit operable to detect a signal across one or more lamps, monitor the signal for disturbances such as an arc, shut down the ballast after a first time delay, and permit automatic restarting of the ballast via the self-oscillating parallel resonant inverter after the duration of a second time delay.

The arc protection circuit functions to promptly and effectively detect a potentially damaging arc in the signal across the one or more lamps and disable the ballast. The severity of the arc in part determines the rapidity in which the ballast is disabled. The circuit further functions to prevent disabling of the ballast in response to undesirable triggers such as during re-lamping or other alternative conditions where the arc is not sustained. The circuit is further desirable as being relatively inexpensive, easily implemented and having time delays that are adjustable to the needs of a user.

Briefly stated, in an embodiment a protection circuit for an electronic ballast is provided, the circuit including a lamp signal sensing circuit coupled across one or more lamps and designed to detect a signal through the lamps, a shutdown circuit coupled to the sensing circuit and operable to disable the ballast in response to a large rate of change in the detected signal, at least a portion of the shutdown circuit defining a first time delay after which the ballast is disabled, and an automatic restart delay circuit coupled to the shutdown circuit and operable to enable restarting of the ballast, at least a portion of the restart circuit defining a second time delay during which the ballast remains disabled, after which the ballast may be restarted. The lamp signal sensing circuit may include a signal sensing transformer having a primary winding coupled to the lamps and a secondary winding coupled to the shutdown circuit.

In another embodiment of the present invention, a circuit is provided for shutting down an electronic ballast in response to an electrical disturbance. The circuit includes a signal sensing device operable to detect a signal across one or more lamps powered by the ballast, a first switching element having a threshold, a second switching element having a threshold, and shutdown circuitry coupled between the signal sensing device and the first switching element, the circuitry effective to transfer the signal detected by the sensing device to a DC signal operable to turn on the first and second switching elements when a disturbance is detected. When the DC signal exceeds the threshold of the first switching element, the second switching element when turned on is arranged to disable the ballast. The shutdown circuitry further includes a first capacitor having a charging time, the charging time of the first capacitor defining a first time delay between detection of the disturbance and disabling of the ballast.

In another embodiment of the present invention, an electronic ballast using a current-fed, parallel resonant inverter for powering one or more gas discharge lamps is provided, the ballast further having a signal sensing circuit operable to detect an electrical signal across the one or more lamps, a shutdown circuit operable to monitor the detected signal for a disturbance in the signal and to disable the ballast after a first predetermined time delay, and a restart circuit operable to prevent restarting of the ballast during a second predetermined time delay measured from disabling of the ballast.

DETAILED DESCRIPTION OF THE INVENTION

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein may or may not refer to the same embodiment. The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data or other signal. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa. The term "load" means one or more gas discharge lamps, electrical components, and/or any other devices that consume electric power during normal operation.

Referring generally to FIGS. 1-4 and the following detailed description, various embodiments of an arc protection circuit 10 are provided for an instant-start type electronic ballast having, for example, a current-fed, parallel resonant inverter capable of powering a load. The protection circuit 10 is capable of measuring a voltage across the load and detecting a disturbance such as an arc having a rate of change substantially in excess of normal operation. The circuit 10 is further capable of shutting down the ballast after a predetermined time period defined by associated circuitry. The predetermined time period is preferably sufficient to permit normal startup of the ballast but short enough to efficiently disable the ballast in response to a true and potentially damaging arc.

The circuit 10 is further adaptive in that the severity of the arc determines how soon the time period is tolled and indeed whether or not the ballast is shut down after the time period has elapsed. The circuit 10 is further capable of subsequently preventing a restart of the ballast for a second predetermined time period after the ballast has been shut down. After the second time period has elapsed, the ballast may automatically restart in embodiments such as shown including a self-oscillating inverter.

Figure 1:
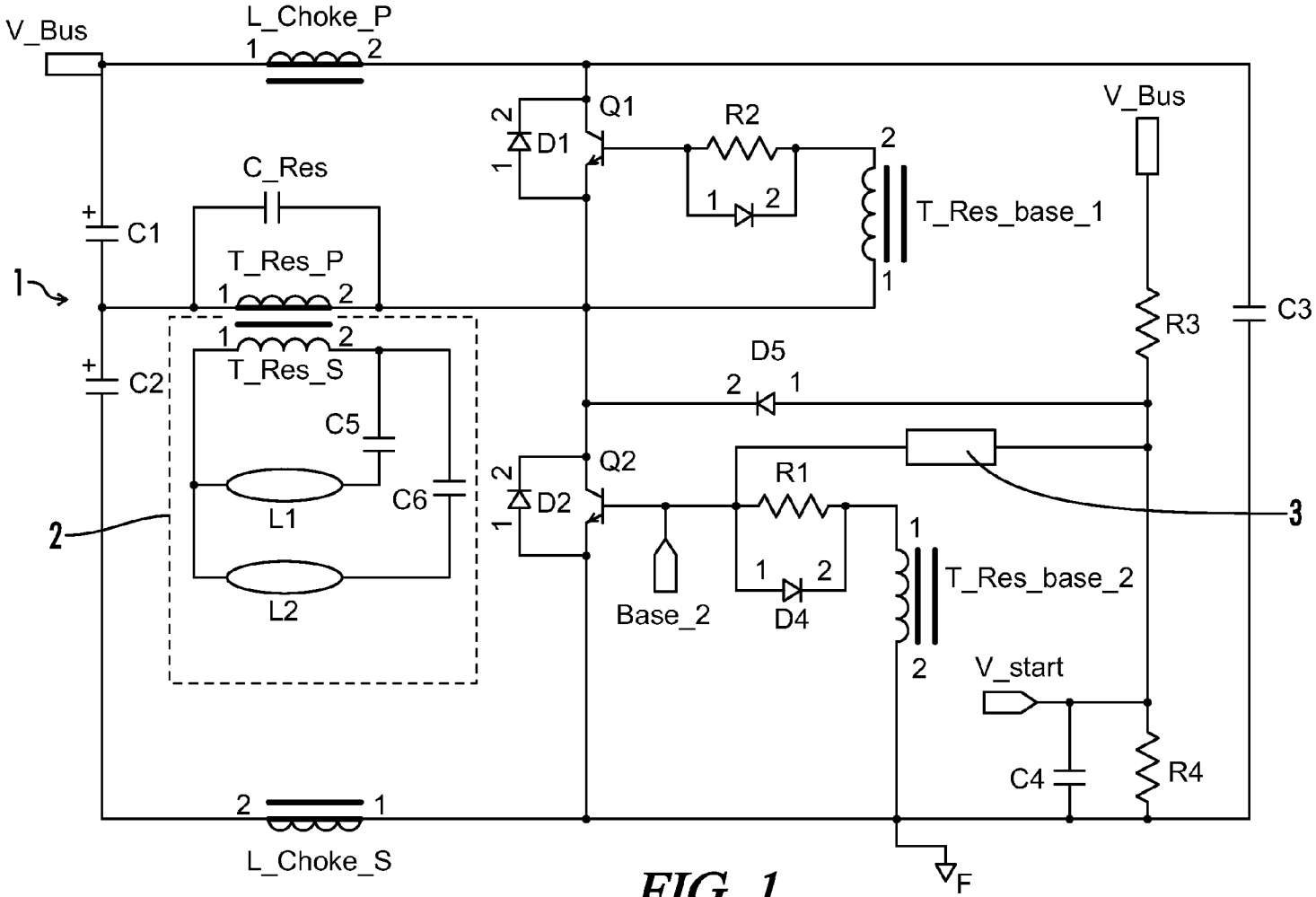
FIG. 1 (PRIOR ART)
FIG. 1 is a schematic of a typical circuit topology for dual-lamp current-fed parallel-resonant circuit of the prior art.
Figure 2:
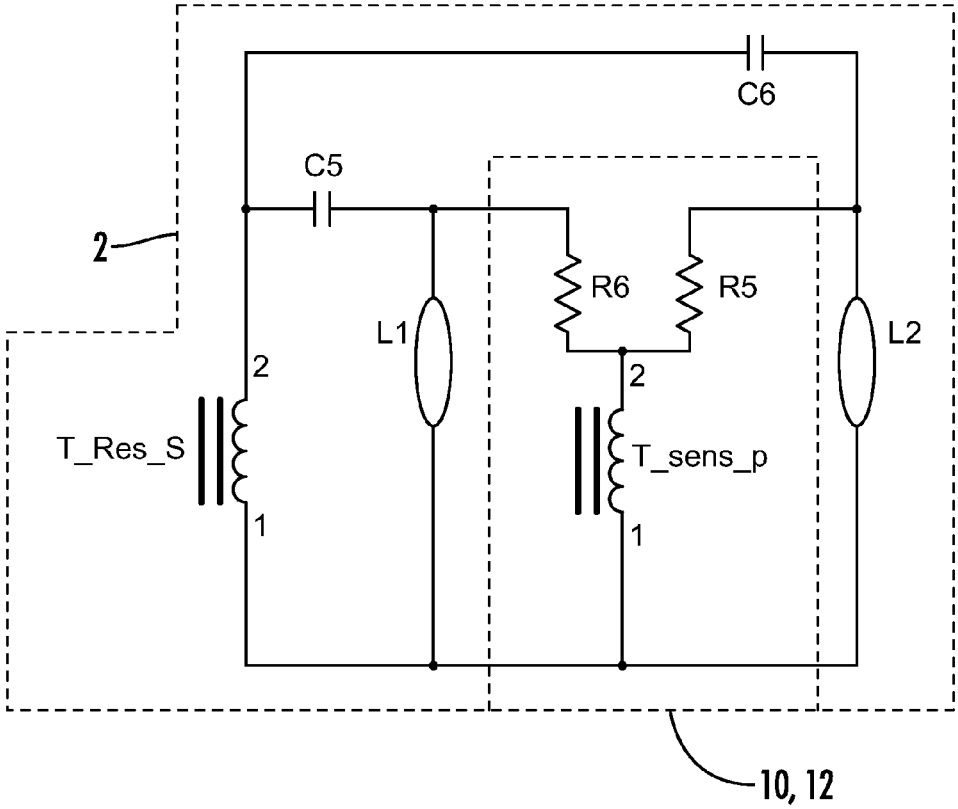
FIG. 2 is a schematic of a lamp voltage sensing circuit of an embodiment of the present invention coupled with the load circuit of FIG. 1.

Referring now to FIGS. 1-2, a load circuit 2 coupled to a typical current-fed, parallel resonant inverter ballast 1 further includes a lamp voltage sensing circuit 12 coupled in parallel across the terminals of the two lamps L1, L2 as shown. A first end of a primary winding of a voltage sensing transformer T_sens_p is coupled to a first end of the lamps L1, L2 via resistors R6, R5, respectively. A second end of the primary winding T_sens_p is coupled to a second end of the lamps L1, L2. Resistors R5, R6 and the primary winding of the voltage sensing transformer T_sens_p together are capable of sensing the voltage across the lamps L1, L2.

Figure 3:
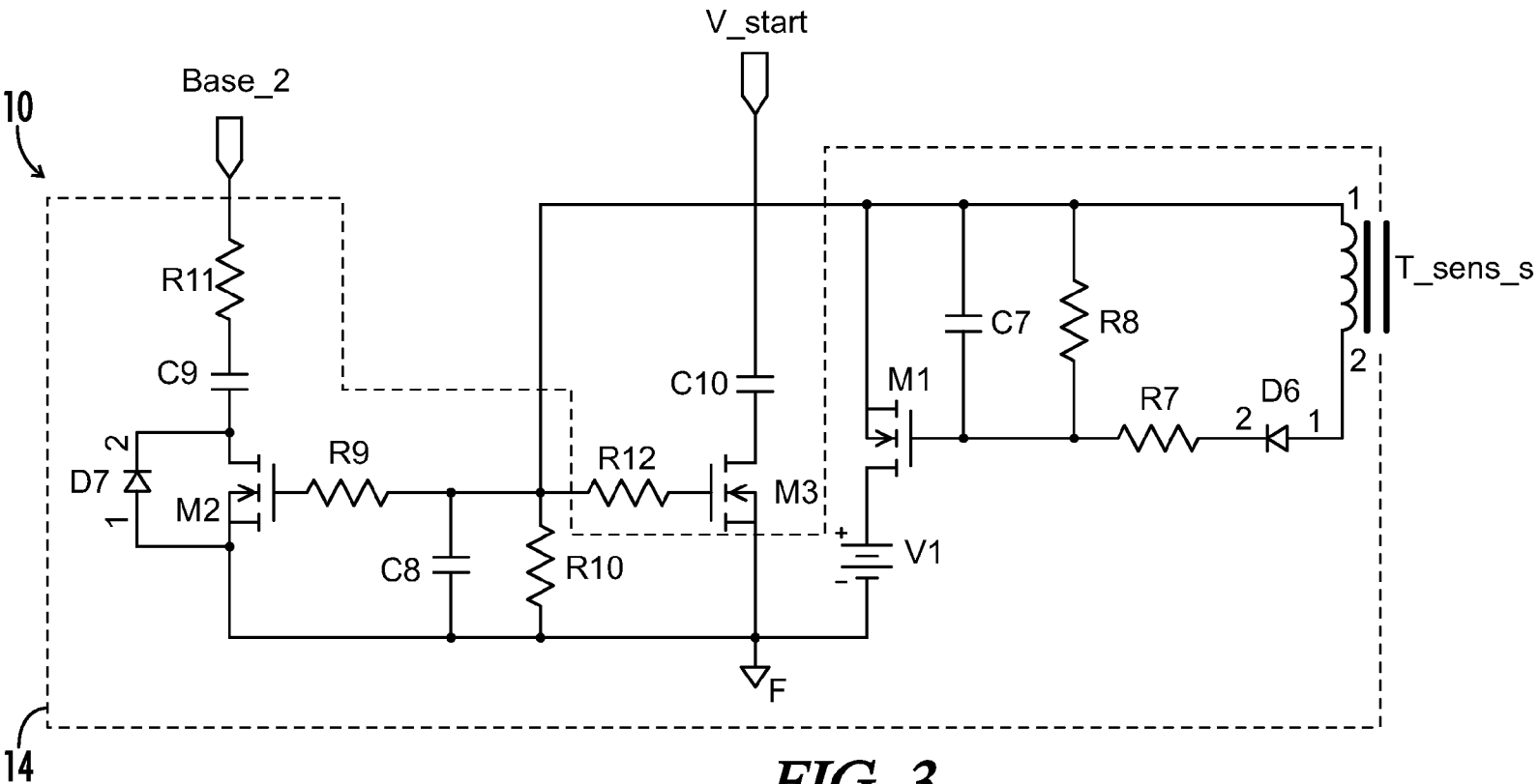
FIG. 3 is a schematic of an arc protection circuit of the present invention showing an embodiment of a shutdown circuit.

Referring now to FIG. 3, in an embodiment of the arc protection circuit 10 a shutdown circuit 14 is provided. The shutdown circuit 14 may be coupled to the voltage sensing circuit 12 of FIG. 2 via a secondary winding of the voltage sensing transformer T_sens_s. Shutdown circuitry including capacitor C7, two resistors R7, R8 and diode D6 are coupled to the secondary winding T_sens_s. A first switching element M1 or MOSFET M1 is coupled to the shutdown circuitry in parallel across its gate and source. A DC voltage source is coupled to the drain of the first switching element M1. The DC voltage source is further coupled to resistor R10, capacitor C8 and the source of second switching element M2 or MOSFET M2. Capacitor C8 and resistor R10 are further coupled to a node series-connected to the gate of second switching element M2 and resistor R9.

In embodiments as shown and previously described, the shutdown circuit 14 may be able to detect a signal across the one or more lamps L1, L2 via the secondary winding T_sens_s. During normal operation the lamp voltage is quite small, and the voltage across the capacitor C7 is correspondingly small enough that it is generally less than the threshold voltage of first switching element M1. Since the first switching element M1 is turned off and open during this period of normal operation, the voltage across capacitor C8 is zero volts and therefore second switching element M2 is turned off and open as well.

Referring now to FIGS. 1 and 3, diode D7 is the body diode of second switching element M2. Capacitor C9 and resistor R11 are series-connected between second switching element M2 and the inverter driving the load, more particularly transistor Q2. During normal operation capacitor C9 is peak charged by the base drive winding T_res_base_2 through resistor R11 and diode D7. The voltage across capacitor C9 is therefore during normal operation negative with respect to ground F.

When, for example, an arc occurs in the electrical signal across the lamps L1, L2, the voltage across the lamps L1, L2 increases dramatically. As a result, the voltage across primary winding T_sens_p is large enough to create a large DC signal across capacitor C7, which may turn on first switching element M1.

Capacitor C7 has a charging time that is selectable and defines a first time delay between detection of the arc and turning on of the first switching element M1. The turning on time for the first switching element M1 is also affected by the severity of the arc, as an arc having a significantly large rate of change relative to normal operation will trigger the charging time for the capacitor C7 more rapidly. Further, a relatively sustained arc will be necessary to turn on the first switching element M1 because in that case the detected signal across the lamps L1, L2 remains larger than the threshold for the first switching element M1 after the first time delay has elapsed, while an instantaneous arc may not turn on the first switching element M1 where normal operation has been restored by the time the first time delay has elapsed. This feature of various embodiments of the present invention may thereby prevent certain false or undesirable shutdowns such as during re-lamping or normal startup conditions for example, while effectively and rapidly disabling the inverter for true and dangerous arcs.

After first switching element M1 is turned on, in certain embodiments the DC source V1 may be used to charge capacitor C8 immediately above the turn-on threshold voltage of second switching element M2. As soon as second switching element M2 is turned on, the negative voltage previously across capacitor C9 will cross the base to the emitter of transistor Q2, forcing transistor Q2 to turn off. Turning off of transistor Q2 will disable the self-oscillation of the inverter. Therefore, disabling of the inverter and by extension the ballast itself occurs after a first time delay in association with a detected sustained arc across one or more of the lamps L1, L2.

Figure 4:
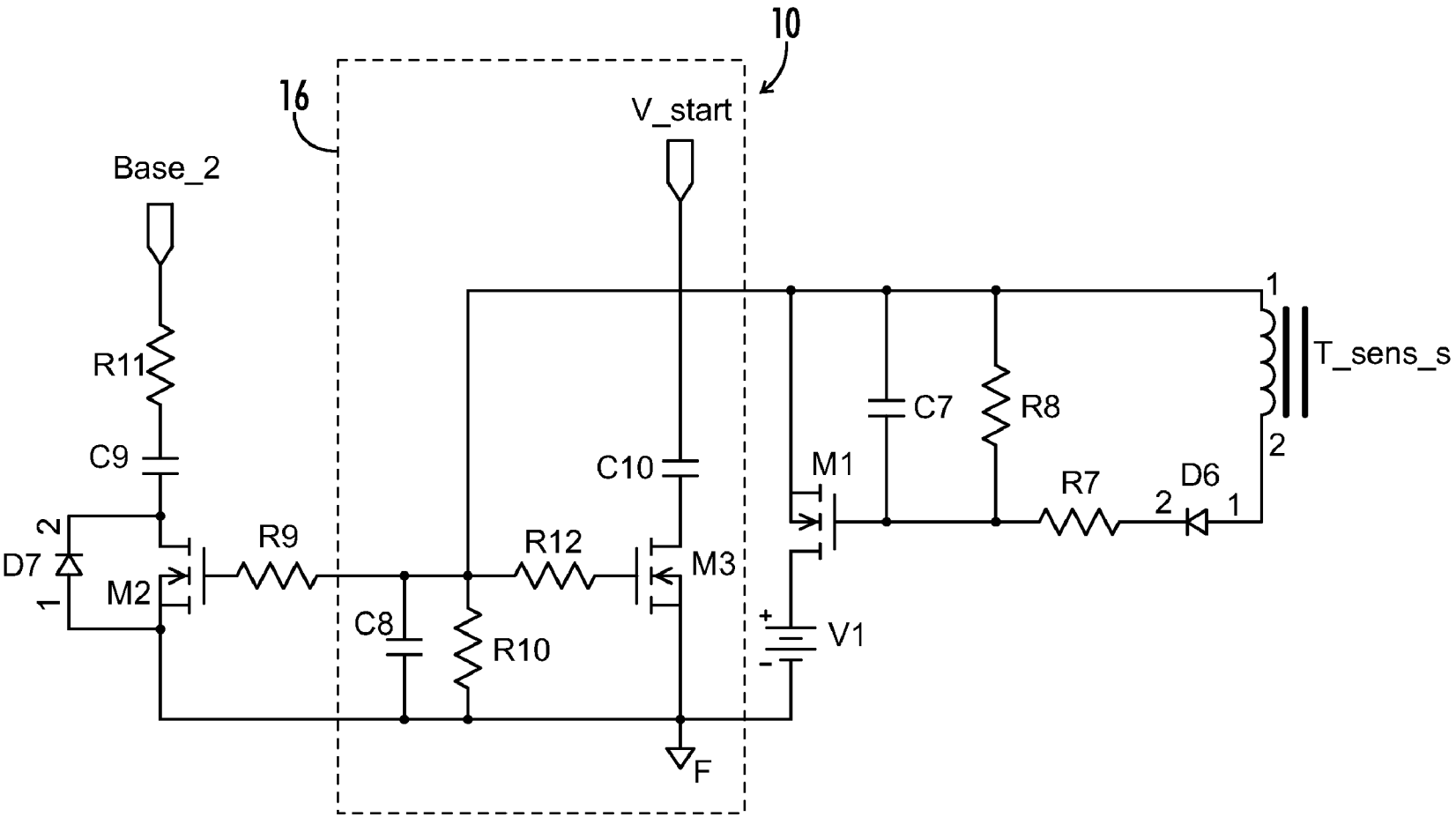
FIG. 4 is a schematic of the arc protection circuit of FIG. 3 showing an embodiment of an automatic restart circuit.

Referring now to FIGS. 1 and 4, in an embodiment of the arc protection circuit 10 a restarting circuit 16 or automatic restarting delay circuit 16 is provided. The source of a third switching element M3 or MOSFET M3 is coupled to the DC source V1. The gate of third switching element M3 is coupled to a resistor R9 that is further coupled to the parallel-connected capacitor C8 and resistor R10. The drain of third switching element M3 is coupled to capacitor C10, which is further coupled to terminal V_start.

In certain embodiments where first switching element M1 is turned on and DC source V1 is used to immediately charge capacitor C8 and turn on second switching element M2, DC source V1 and capacitor C8 further turn on third switching element M3. Turning on third switching element M3 further prevents the inverter from restarting after it has been disabled by the shutdown circuit. Because third switching element M3 is on, capacitor C10 is effectively in parallel with capacitor C4. Capacitor C10 may be designed to be very large such that the recharging time of capacitors C10, C4 through resistors R3, R4 will be very long. As long as the voltage across capacitors C10, C4 does not reach the breakdown voltage of the diac 3, the inverter cannot be restarted.

Capacitor C8 may be designed to be large enough to hold its charge for a relatively long time such that second and third switching elements M2, M3 remain on for a second predetermined time delay. When capacitor C8 has become discharged through resistor R10, second and third switching elements M2, M3 are then turned off. Once third switching element M3 is turned off, capacitor C10 is removed from the restarting circuit loop, and the inverter may as a result restart normally. The inverter as shown in FIG. 1 is a self-oscillating inverter using a diac with a breakdown voltage as known in the art, but it may be understood that various other methods of automatically restarting the inverter oscillation after elapsing of the second time delay may be possible within the scope of the present invention.

It may be further understood that in various embodiments as shown in FIG. 4 and previously described, the second time delay corresponds to the discharge time of the capacitor C8 and may be selectably changed by varying the values of capacitor C8 and resistor R10. In this manner the second time delay may be desirably selected in accordance with user requirements.

The previous detailed description has been provided for the purposes of illustration and description. Thus, although there have been described particular embodiments of the present invention of a new and useful "Anti-Arcing Circuit for Current-Fed Parallel Resonant Inverter," it is not intended that such references be construed as limitations upon the scope of this invention except as set forth in the following claims.

What is claimed is:

1. A protection circuit for an electronic ballast, the circuit comprising:
- a lamp signal sensing circuit coupled across one or more lamps and designed to detect a signal through the lamps;
- a shutdown circuit coupled to the sensing circuit and operable to disable the ballast in response to a disturbance in the detected signal, at least a portion of the shutdown circuit defining a first time delay from detection of the disturbance in the signal during which the ballast operates normally, and after which the ballast may be disabled in response to the disturbance;
- an automatic restart circuit coupled to the shutdown circuit and operable to enable restarting of the ballast, at least a portion of the restart circuit defining a second time delay during which the ballast remains disabled, after which the ballast may be restarted;
- the shutdown circuit further comprising
  - a first switching element having a threshold,
  - shutdown circuit coupled between the lamp signal sensing circuit and the first switching element, the circuit effective to transfer the signal detected by the sensing circuit to a DC signal driving the switching element,
  - a DC voltage source coupled to the first switching element, and
  - a second switching element having a threshold and coupled to the DC voltage source, the DC voltage source operable to drive the second switching element when the first switching element is on, the second switching element when turned on arranged to disable the ballast;
- the shutdown circuit further comprising a first capacitor, the charging time of the first capacitor selectable to define the first time delay; and
- the automatic restart circuit further comprising
- a third switching element coupled to the DC voltage source and arranged to be turned on in association with the second switching element,
- a second capacitor coupled to the third switching element, the charging time of the second capacitor effective to prevent startup while the third switching element is on, and
- a third capacitor and a resistor coupled in parallel and selectable to define the second time delay.

2. The circuit of claim 1, the third capacitor and the resistor further coupled to the second and third switching elements wherein discharge of the third capacitor turns off the second and third switching elements and enables restarting of the ballast.

3. The circuit of claim 1, each of the first, second and third switching elements comprising a MOSFET.

4. A circuit for shutting down an electronic ballast in response to an electrical disturbance, the circuit comprising:
- a signal sensing device operable to detect a signal across one or more lamps powered by the ballast;
- a first switching element having a threshold;
- a second switching element having a threshold; and shutdown circuitry coupled between the signal sensing device and the first switching element, the shutdown circuitry effective to transfer the signal detected by the sensing device to a DC signal operable to turn on the first and second switching elements when a disturbance is detected, wherein the DC signal exceeds the threshold of the first switching element, the second switching element when turned on arranged to disable the ballast, the shutdown circuitry further comprising a first capacitor having a charging time, the charging time of the first capacitor defining a first time delay between detection of the disturbance and disabling of the ballast;

a DC voltage source coupled to the first and second switching elements, the DC voltage source operable to provide a signal to the second switching element exceeding the threshold of the second switching element when the first switching element is on, wherein the second switching element is immediately turned on when the first switching element is turned on;

a third switching element coupled to the DC voltage source and arranged to be turned on in association with the second switching element;

a second capacitor coupled to the third switching element and having a charging time, the second capacitor effective to prevent startup while the third switching element is on; and a third capacitor and a resistor coupled in parallel and selectable to define a second time delay between disabling of the ballast and restarting of the ballast.

5. The circuit of claim 4, the third capacitor and the resistor further coupled to the second and third switching elements wherein discharge of the third capacitor turns off the second and third switching elements and enables restarting of the ballast.

6. The circuit of claim 4, the first, second and third switching elements comprising MOSFETs.

7. An electronic ballast comprising a current-fed, parallel resonant inverter for powering one or more gas discharge lamps, the ballast further comprising:

a signal sensing circuit operable to detect an electrical signal across the one or more lamps;

a shutdown circuit operable to monitor the detected signal for a disturbance in the signal and to disable the ballast after a first predetermined time delay; and an automatic restart delay circuit operable to prevent restarting of the ballast during a second predetermined time delay measured from disabling of the ballast;

the signal sensing circuit comprising a transformer having a primary winding coupled to the one or more lamps and a secondary winding coupled to the shutdown circuit;

a capacitor coupled in parallel to the signal sensing circuit and further coupled in parallel to a gate and source of a first MOSFET having a threshold; and a second MOSFET coupled to the first MOSFET and further coupled to the inverter, the second MOSFET arranged to turn on when the first MOSFET is turned on, the shutdown circuit operable to turn on the first MOSFET when the detected signal exceeds the threshold of the first MOSFET after a charging time of the capacitor, the shutdown circuit further arranged to disable oscillation of the inverter when the second MOSFET is turned on, the capacitor charging time selectable in association with the first predetermined time delay.

8. The ballast of claim 7, the restart circuit further comprising:

a third MOSFET arranged to be turned on in association with the second MOSFET;

a second capacitor coupled to the third MOSFET and having a charging time, the second capacitor effective to prevent startup while the third MOSFET is on; and a third capacitor and a resistor coupled in parallel and further coupled to the gates and sources of the second and third MOSFETs, the third capacitor and the resistor selectable to define the second time delay between disabling of the ballast and restarting of the ballast, wherein discharge of the third capacitor turns off the second and third MOSFETs and enables restarting of the ballast.

* * * * *